United States Patent [19]

Campbell et al.

[11] Patent Number: 4,817,239

[45] Date of Patent: Apr. 4, 1989

[54] DOOR HOOK

[76] Inventors: Sheila R. Campbell; Frank J, Campbell, both of 54123 Buccaneers Bay, Utica, Mich. 48087

[21] Appl. No.: 112,471

[22] Filed: Oct. 26, 1987

[51] Int. Cl.[4] ..... E05B 1/00

[52] U.S. Cl. ..... 16/114 R; 16/124; 16/125; 16/DIG. 25

[58] Field of Search ..... 16/114 R, 124, 125, 16/382, DIG. 25; 292/347, DIG. 65; 248/214, 215; 211/86, 87

[56] References Cited

U.S. PATENT DOCUMENTS

| | | | |
|---|---|---|---|
| 1,487,264 | 3/1924 | Raymer | 16/125 |
| 2,238,513 | 4/1941 | Ward | 16/112 |
| 2,835,524 | 5/1958 | Russell | 292/337 |
| 2,904,368 | 9/1959 | Taubman | 16/110 |
| 3,121,907 | 2/1964 | Stebbins | 16/126 |
| 3,152,818 | 10/1964 | Ivins | 16/114 R |
| 3,536,287 | 10/1970 | Kramer | 248/215 |

FOREIGN PATENT DOCUMENTS

| | | | |
|---|---|---|---|
| 302776 | 1/1929 | United Kingdom . | |
| 654890 | 7/1951 | United Kingdom | 248/215 |

*Primary Examiner*—Nicholas P. Godici
*Assistant Examiner*—Edward A. Brown
*Attorney, Agent, or Firm*—Reising, Ethington, Barnard, Perry & Milton

[57] ABSTRACT

A sanitary door opening assembly (10) comprising a U-shaped bracket (12) disposed around the outer edge (20) and sides (14,15) of a door (16). A hook (24) is mounted to the U-shaped bracket (12) and door (16) by fasteners (52). The hook (24) is defined by an arcuate pocket (26) opening toward the outer swinging edge (20) of the door (16) for receiving a human forearm to pull open the door (16).

14 Claims, 1 Drawing Sheet

DOOR HOOK

TECHNICAL FIELD

This invention relates to a door opening assembly whereby the door can be pulled open with a human forearm.

BACKGROUND ART

Various assemblies for pulling open a door are known in the prior art. The U.S. Pat. No. 1,487,264 to Raymer discloses a decorative door opener attached to a door face with a projection extending vertically upwardly and outwardly. The U.S. Pat. Nos. 3,121,907 to Stebbins, 2,904,368 to Taubman, and 2,238,513 to Ward additionally disclose door openers of various hook configurations and orientations. However, the prior art fails to remedy the problem and discomfort occurring when the individual attempts to remove his forearm from the door hook. The various hook configurations formed in the prior art require the individual to deliberately pause after pulling open the door so as to disengage the forearm before passing through the doorway. Further, there is a need for a door opener of simple construction for easy and rapid mounting on existing doors.

SUMMARY OF THE INVENTION AND ADVANTAGES

In accordance with the present invention, there is provided a sanitary door opener assembly for mounting upon a door for opening same, a bracket adapted to be mounted on one side of the door with a forward extremity thereof adjacent the outer swinging edge of the door and a generally U-shaped bracket for presenting a concave pocket opening toward the outer swinging edge of the door for receiving a human forearm to open the door.

This specific disposition of the hook is particularly advantageous when pulling open a door with the forearm. When the door has been pulled open far enough to effect an exit, the forearm can be easily disengaged from the hook by pulling the arm in the direction the individual exits through the doorway. In other words, it is not necessary to deliberately disengage the forearm from the concave pocket of the hook since the forearm will naturally follow out of the hook in the direction the individual exits through the doorway, thereby enabling a swift and unrestricted exit. In addition, the assembly is of simple construction and easily attached to doors already in use.

This door opener assembly is particularly useful when incorporated onto the public restroom doors of an eating establishment or the like where, after having washed his hands, the individual can open the restroom door with his forearm thereby not exposing his hands to a germ infested restroom door handle before partaking in his meal.

In addition, the subject invention lends itself to easy use by the handicapped whose hands are not capable of grasping and pulling open a standard door handle. Similarly, an individual carrying an armful of goods will find it more convenient to open a door equipped with the subject door opener assembly since the door can be opened without the use of the hands. If an individual does not wish to use a forearm to open the door as described, the hook 24 can be grasped by the hand as any standard door pull and opened in the conventional manner.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
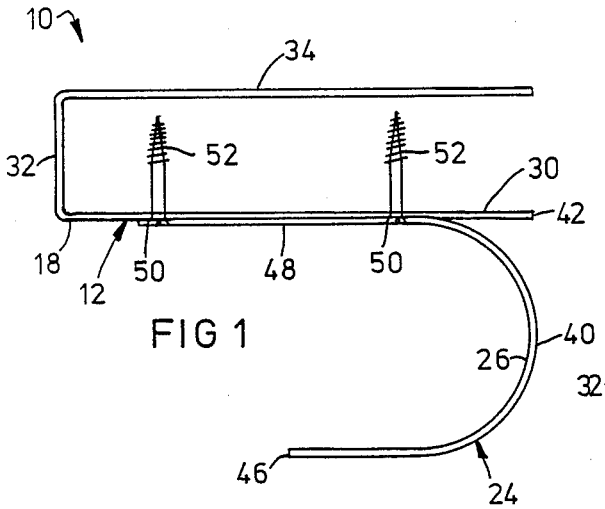
FIG. 1 is a top view of the preferred embodiment of the door hook assembly.
Figure 4:
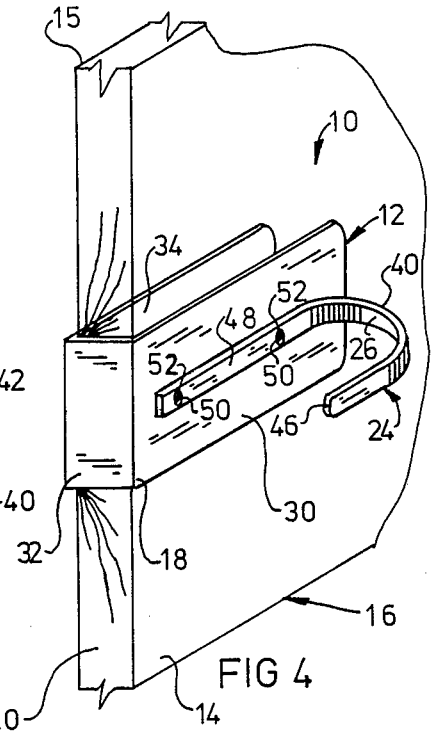
FIG. 4 is an isometric view of the preferred embodiment of the door hook assembly.
Figure 2:
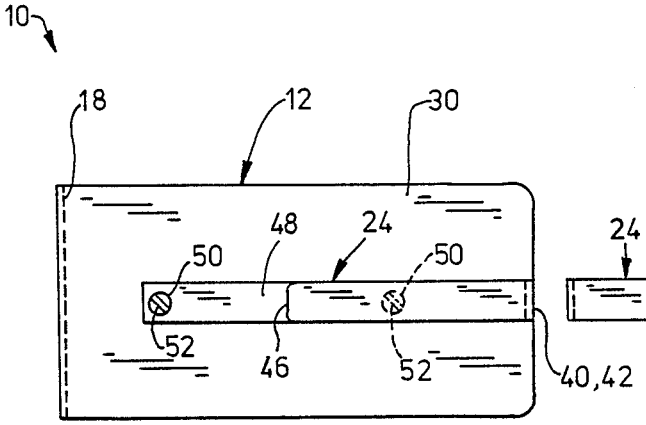
FIG. 2 is a front view of the preferred embodiment of the door hook assembly.
Figure 3:
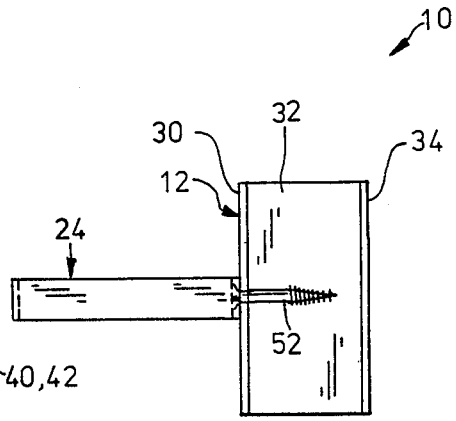
FIG. 3 is an end view of the preferred embodiment of the door hook assembly.

A sanitary door opening assembly for pulling open a door with the forearm is generally shown at 10. The door is of any well known structure having parallel sides or faces 14 and 15 interconnected by a front swinging edge 20. The door opening assembly comprises a bracket 12 adapted for mounting onto the opposite sides or faces 14 and 15 of the door 16. A forward extremity 18 of the bracket 12 is positioned adjacent the outer swinging edge 20 of the door 16.

A generally U-shaped hook 24 extends from the bracket 12 in a horizontal plane perpendicular to the forward extremity 18 of the bracket 12. The hook 24 defines a concave pocket 26 opening toward the outer swinging edge 20 of the door 16.

The bracket 12 includes at least one side plate 30 for engaging the side 14 of the door 16. A front plate 32 is included in the bracket 12 for engaging the outer swinging edge 20 of the door 16. The preferred embodiment also includes a second side plate 34 extending from the front plate 32 in parallel relationship to the first mentioned side plate 30 to define a U-shaped bracket 12 for disposition around the outer edge 20 of the door 16 and to engage the opposite sides 14 and 15 of the door 16. In other words, the U-shaped bracket 12 is adapted to slide snugly over the exterior of swinging edge 20 and the faces 14, 15 of the door 16.

A bottom 40 or rear extremity of the U-shaped hook 24 is substantially aligned with a rear extremity or edge 42 of the first side plate 30. The hook 24 extends out from first side plate 30 through an arc defining a concave pocket 26 to a distal end 46. The distal end 46 is spaced out from the first side plate 30 at least far enough to receive a human forearm into the concave pocket 26. The distal end 46 is disposed rearwardly from the forward extremity 18 at a distance at least as large as the distance between the distal end 46 and first side 30. In this manner, if the outer swinging edge 20 abuts a structural wall extending perpendicular to the first plate 30, there will exist sufficient clearance between the wall and distal end 46 for a human forearm to pass therebetween for engagement with the concave pocket 26.

The hook 24 includes a second leg 48 for mounting to the first side plate 30. The leg 48 is provided with holes 50 corresponding with holes in the first side plate 30 through which fasteners 52 extend into the door 16. The fasteners 52 retain the hook 24 onto the bracket 12 and secure the assembly 10 to the door 16. The fasteners 52 may extend fully through the door 16 and be retained by nuts (not shown) on the exterior of the second side plate 34.

The side plates 30, 34 are generally characterized as being rectangular in shape with the front to rear length being approximately twice the top to bottom height. In other words, the side plates 30, 34 are nearly twice as long as they are tall. The distal end 46 of the hook 24 is disposed substantially midway between the front 18 and rear 42 extremities of the first side plate 30.

Alternatively, the hook 24 can be attached to the door 16 directly by eliminating the bracket 12. In this embodiment, the hook 24 is maintained in the same orientation with respect to the door 16 as in the former embodiment.

In operation, the door opener assembly 10 is affixed to a door 16 such that the hook 24 is located on the inward side 14 of the door 16 at a convenient height somewhere between waist and chest height. The door 16 is opened by placing a forearm into the concave pocket 26 of the hook 24 and pulling the door 16 in the direction of the door swing. Once the door 16 has been opened far enough for the individual to pass through the doorway, the forearm is easily removed from the hook 24 as the individual proceeds through the doorway. This easy forearm removal from the hook 24 is due to the concave pocket 26 projecting towards the outer swinging edge 20 of the door 16. In other words, the individual can effect a swift unrestricted exit since the forearm will naturally disengage from the hook 24 as the individual walks through the doorway.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A sanitary door opener assembly (10) for mounting upon and opening a door (16) having an outer swinging edge (20), said assembly (10) comprising;

a bracket (12) adapted to be mounted on one side (14) of the door (16) with a forward extremity (18) thereof adjacent the outer swinging edge (20) of the door (16);

a generally U-shaped hook (24) non-movably fastened to said bracket (12) and extending from said bracket (12) in a plane perpendicular to said forward extremity (18) of said bracket (12) for presenting a concave pocket (26) opening toward the outer swinging edge (20) of the door (16) for receiving a human forearm to open the door;

said assembly (10) characterized by the width of said bracket (12) measured in a direction parallel to said forward extremity (18) being at least twice the width of said hook (24) measured in a direction parallel to said forward extremity (18).

2. An assembly (10) as set forth in claim 1 wherein said bracket (12) includes at least one side plate (30) for engaging the side (14) of the door (16) and a front plate (32) for engaging the outer swinging edge (20) of the door (16), said U-shaped hook (24) opening toward said front plate (32).

3. An assembly (10) as set forth in claim 2 wherein said bracket (12) includes a second side plate (34) extending from said front plate (32) in parallel relationship to said one side plate (30) to define a U-shaped bracket (12) for disposition around the outer edge (20) of the door (16).

4. An assembly (10) as set forth in claim 3 wherein said side plates (30, 34) have rear extremities and the bottom (40) of said U-shaped hook (24) is substantially aligned with the rear extremity (42) of said side plate (30) from which said hook (24) extends.

5. An assembly (10) as set forth in claim 4 wherein said hook (24) extends from said one side plate (30) through an arc to a distal end (46) spaced from said one side plate (30) and disposed rearwardly from said forward extremity (18) of said one side plate (30).

6. An assembly (10) as set forth in claim 5 wherein the distance from said forward extremity (18) rearward to said distal end (46) is as large as the distance from said one side plate (30) to said distal end (46) and both are large enough to receive a human arm.

7. An assembly (10) as set forth in claim 6 including a leg (48) of said hook (24) against said one side plate (30), aligned with fastener holes (50) for extending fasteners (52) through said leg (48), said one side plate (30) and a door (16) for mounting thereto.

8. An assembly (10) as set forth in claim 7 wherein the front to rear length of said one side plate (30) is twice the top to bottom height thereof.

9. An assembly (10) as set forth in claim 8 wherein said distal end (46) is disposed midway between said front (18) and rear (42) extremities of said one side plate (30).

10. A door (16) and sanitary door opener assembly (10) for opening said door (16), said assembly (10) comprising;

a generally U-shaped hook (24) non-movably supported on said door (16) and extending outwardly therefrom in a horizontal plane perpendicular to an outer swinging edge (20) of said door (16);

said hook (24) presenting a concave pocket (26) facing said outer swinging edge (20) of said door (16) for receiving a human forearm to open said door (16).

11. An assembly (10) as set forth in claim 10 further characterized by including a bracket (12) mounted on one side (14) of said door (16) with a forward extremity (18) thereof adjacent said outer swing edge (20) of said door (16).

12. An assembly (10) as set forth in claim 11 wherein said bracket (12) includes a least one side plate (30) for engaging said side (14) of said door (16) and a front plate (32) for engaging said outer swinging edge (20) of said door (16), said U-shaped hook (24) opening toward said front plate (32).

13. An assembly (10) as set forth in claim 12 wherein said bracket (12) includes a second side plate (34) extending from said front plate (32) in parallel relationship to said one side plate (30) to define a U-shaped bracket (12) for disposition around said outer edge (20) of said door (16).

14. An assembly (10) as set forth in claim 13 wherein said side plates (30,34) have rear extremities and the bottom (40) of said U-shaped hook (24) is substantially aligned with the rear extremity (42) of said side plate (30) from which said hook (24) extends.

* * * * *